US012337938B1

(12) United States Patent
Ledford et al.

(10) Patent No.: US 12,337,938 B1
(45) Date of Patent: Jun. 24, 2025

(54) ADJUSTABLE CHAIR OR LEANING POST FOR KAYAKS AND OTHER WATERCRAFT

(71) Applicants: Henry Ledford, High Point, NC (US); Michael D Ledford, High Point, NC (US); John Ledford Kirkpatrick, High Point, NC (US)

(72) Inventors: Henry Ledford, High Point, NC (US); Michael D Ledford, High Point, NC (US); John Ledford Kirkpatrick, High Point, NC (US)

( * ) Notice: Subject to any disclaimer, the term of this patent is extended or adjusted under 35 U.S.C. 154(b) by 508 days.

(21) Appl. No.: 17/716,041

(22) Filed: Apr. 8, 2022

Related U.S. Application Data

(60) Provisional application No. 63/174,077, filed on Apr. 13, 2021.

(51) Int. Cl.

| | |
|---|---|
| ***B63B 34/26*** | (2020.01) |
| ***B63B 17/00*** | (2006.01) |
| ***B63B 29/04*** | (2006.01) |
| ***B63B 34/21*** | (2020.01) |

(52) U.S. Cl.
CPC ..... *B63B 34/26* (2020.02); *B63B 17/00* (2013.01); *B63B 29/04* (2013.01); *B63B 34/21* (2020.02); *B63B 2029/043* (2013.01)

(58) Field of Classification Search
CPC ..... B63B 34/00; B63B 34/21; B63B 34/26; B63B 2029/043; B63B 17/00; B63B 29/00
USPC ..... 114/285, 363
See application file for complete search history.

(56) References Cited

U.S. PATENT DOCUMENTS

| | | | | |
|---|---|---|---|---|
| 4,803,945 | A * | 2/1989 | Adams | B63B 29/04 114/363 |
| 5,619,949 | A * | 4/1997 | Dick, Jr. | B63B 29/04 114/363 |
| 7,647,880 | B2 * | 1/2010 | Devine | B63B 29/04 114/363 |
| 7,789,035 | B1 * | 9/2010 | Rosenberg | B63B 29/04 114/363 |
| 8,590,478 | B2 * | 11/2013 | Lipman | B63B 34/20 114/363 |
| 9,821,887 | B1 * | 11/2017 | Wilson | B63B 29/04 |

* cited by examiner

*Primary Examiner* — Lars A Olson
(74) *Attorney, Agent, or Firm* — Ashley D. Johnson; Dogwood Patent and Trademark Law

(57) ABSTRACT

The adjustable chair and leaning post for a kayak or other watercraft is configured for use with a vessel and with a client. The adjustable chair and leaning post for a kayak or other watercraft attaches to the superior surface of the vessel. The client uses the adjustable chair and leaning post for a kayak or other watercraft for a purpose selected from the group consisting of: a) sitting; and, b) leaning. The adjustable chair and leaning post for a kayak or other watercraft comprises a framework and a seat structure. The framework transfers the load of the client and seat structure to the vessel. The seating structure forms a structure that the client sits on. The seating structure further forms a structure that the client leans against. The adjustable chair and leaning post for a kayak or other watercraft is a collapsible structure.

20 Claims, 5 Drawing Sheets

ADJUSTABLE CHAIR OR LEANING POST FOR KAYAKS AND OTHER WATERCRAFT

CROSS REFERENCES TO RELATED APPLICATIONS

This non-provisional application claims priority under 35 USC 119 (e) to U.S. provisional application 63,174,077 filed on Apr. 13, 2021 by the inventor: Henry Ledford. This non-provisional application claims U.S. provisional application 63,174,077 in its entirety.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of transportation including waterborne vessels, more specifically, an accessory for a kayak. (B63B34/26)

SUMMARY OF INVENTION

The adjustable chair and leaning post for a kayak or other watercraft is a mechanical structure. The adjustable chair and leaning post for a kayak or other watercraft is configured for use with a vessel. The adjustable chair and leaning post for a kayak or other watercraft attaches to the superior surface of the vessel. The adjustable chair and leaning post for a kayak or other watercraft is adapted for use with a client. The client uses the adjustable chair and leaning post for a kayak or other watercraft for a purpose selected from the group consisting of: a) sitting; and, b) leaning. The adjustable chair and leaning post for a kayak or other watercraft comprises a framework and a seat structure. The framework transfers the load of the client and seat structure to the vessel. The seating structure forms a structure that the client sits on. The seating structure further forms a structure that the client leans against. The adjustable chair and leaning post for a kayak or other watercraft is a collapsible structure.

These together with additional objects, features and advantages of the adjustable chair and leaning post for a kayak or other watercraft will be readily apparent to those of ordinary skill in the art upon reading the following detailed description of the presently preferred, but nonetheless illustrative, embodiments when taken in conjunction with the accompanying drawings.

In this respect, before explaining the current embodiments of the adjustable chair and leaning post for a kayak or other watercraft in detail, it is to be understood that the adjustable chair and leaning post for a kayak or other watercraft is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the adjustable chair and leaning post for a kayak or other watercraft.

It is therefore important that the claims be regarded as including such equivalent construction insofar as they do not depart from the spirit and scope of the adjustable chair and leaning post for a kayak or other watercraft. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
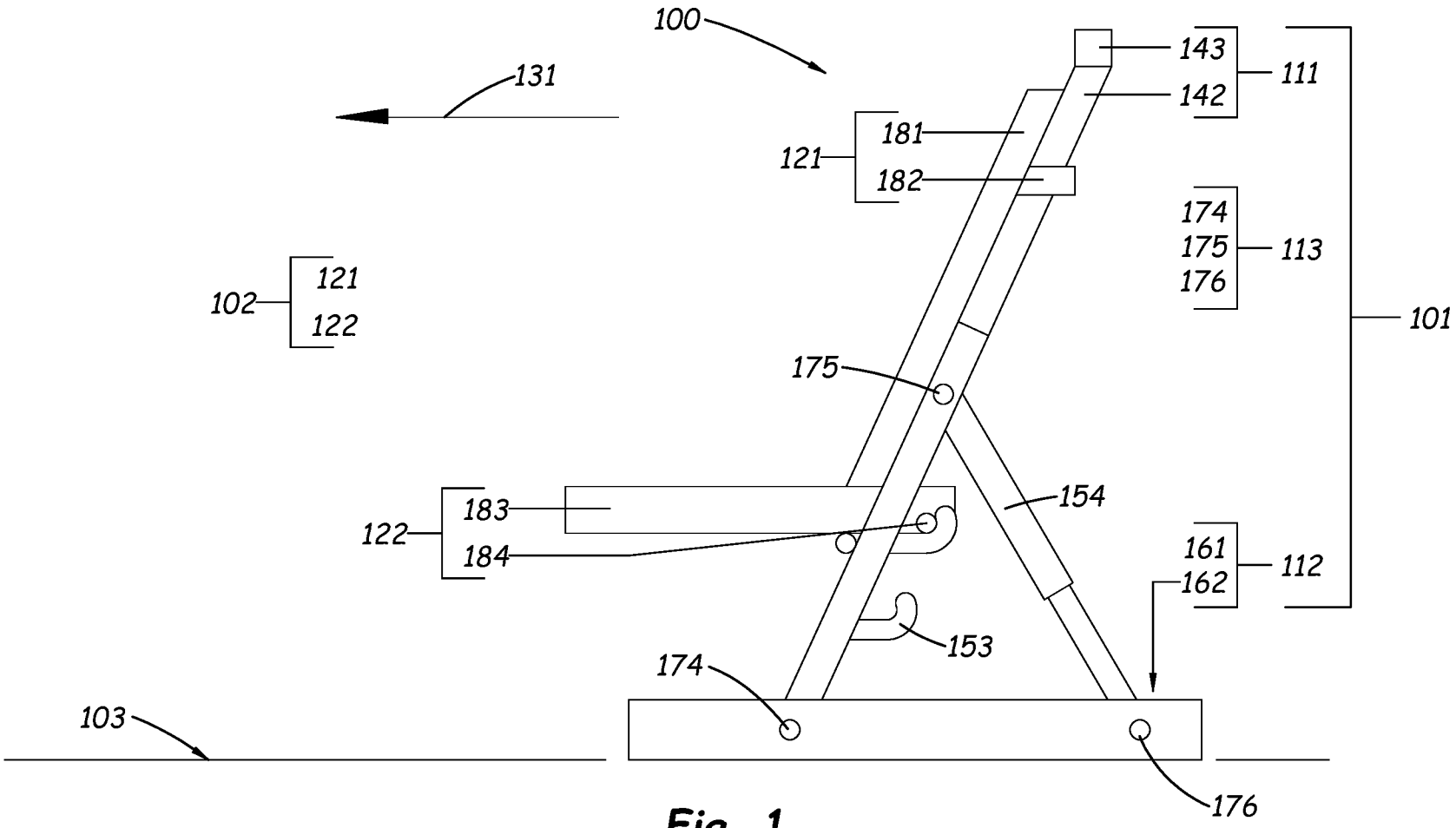
FIG. 1 is a port side view of an embodiment of the disclosure.
Figure 2:
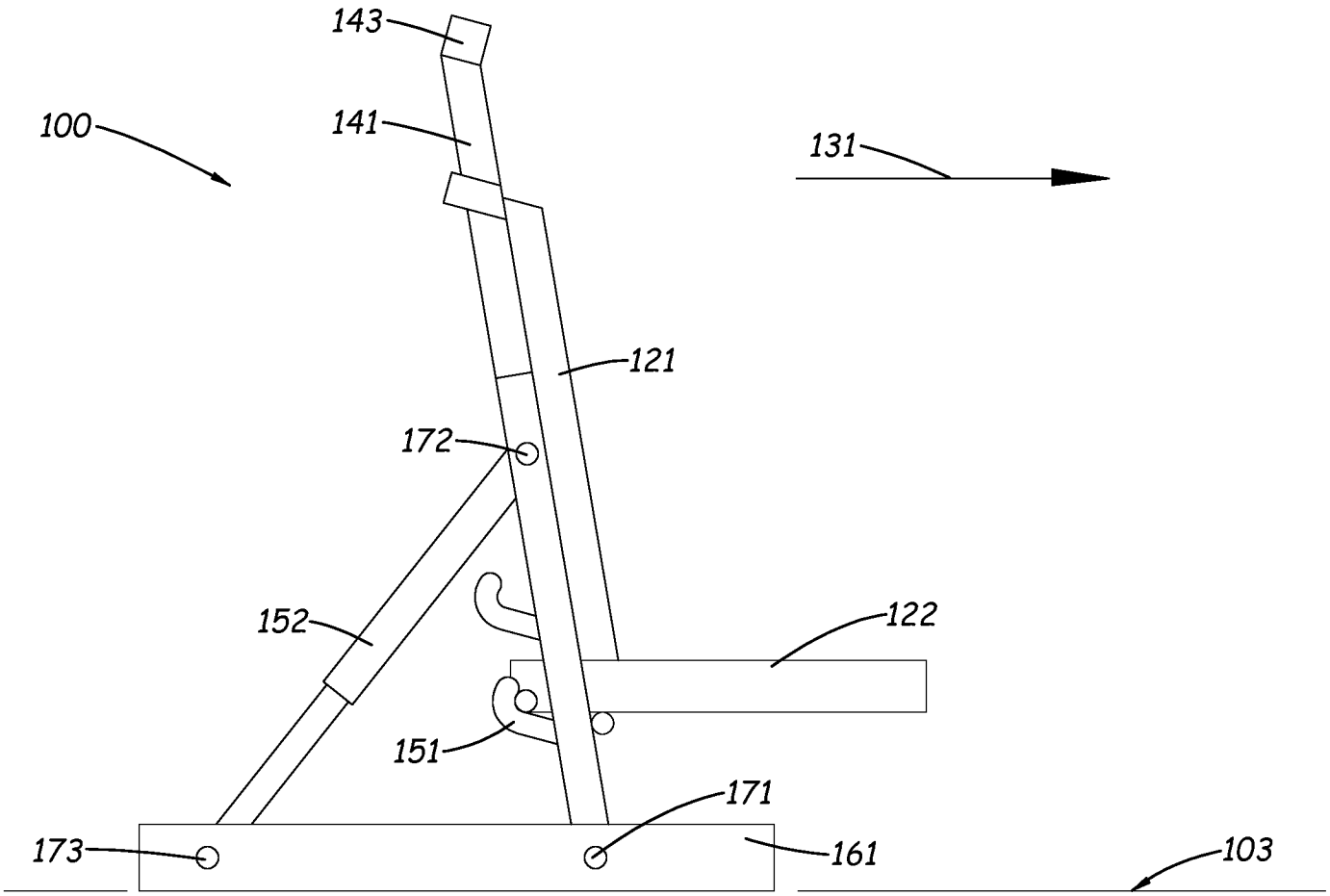
FIG. 2 is a starboard view of an embodiment of the disclosure.
Figure 4:
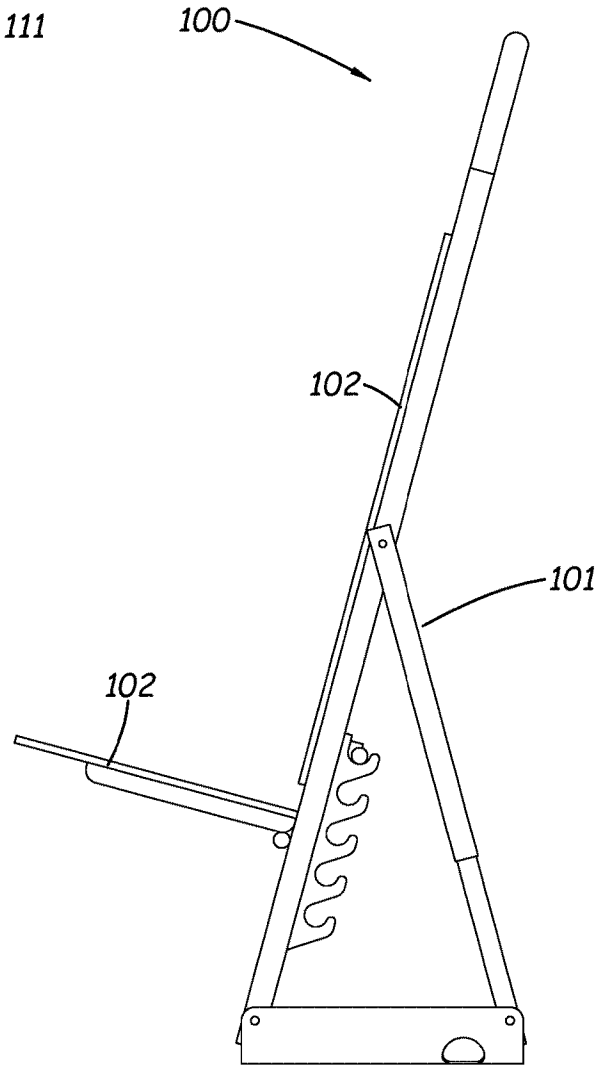
FIG. 4 is a port side view of an embodiment of the disclosure.
Figure 3:
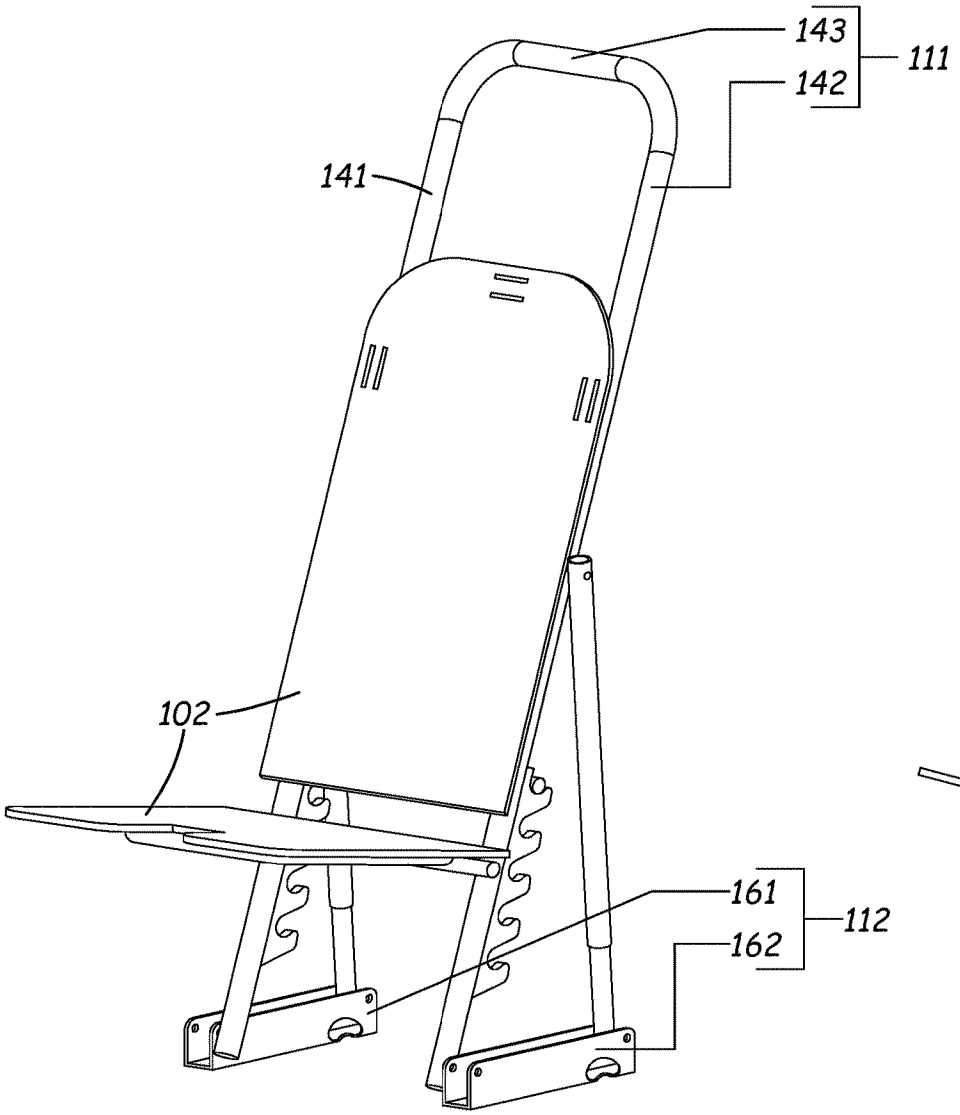
FIG. 3 is a perspective view of an embodiment of the disclosure.
Figure 6:
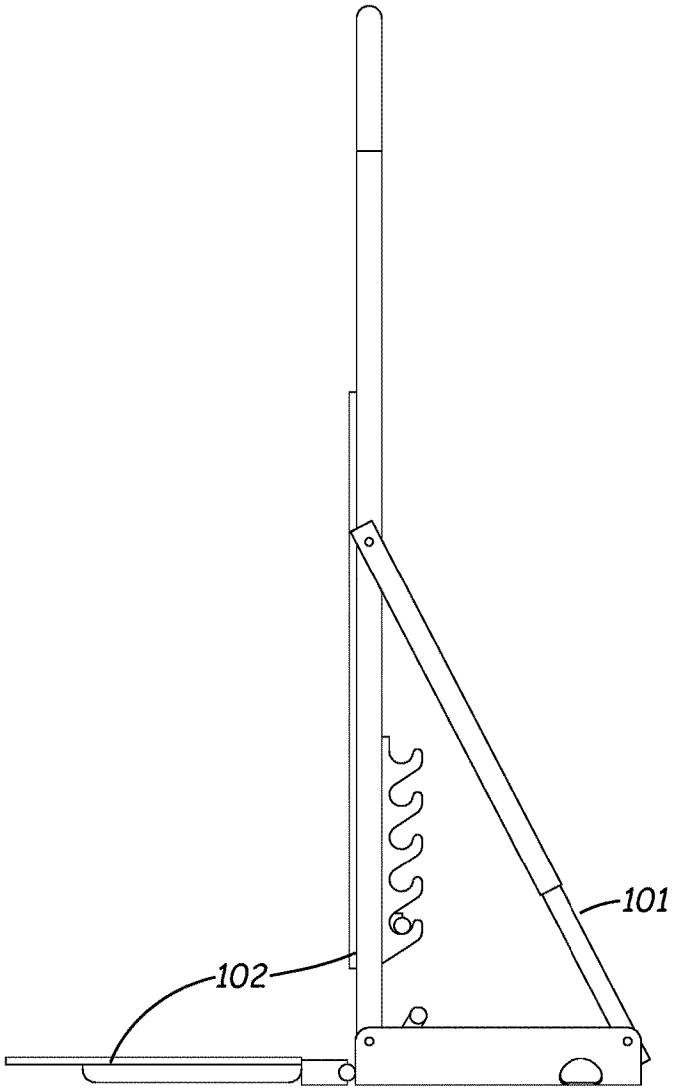
FIG. 6 is a port side view of an embodiment of the disclosure.
Figure 5:
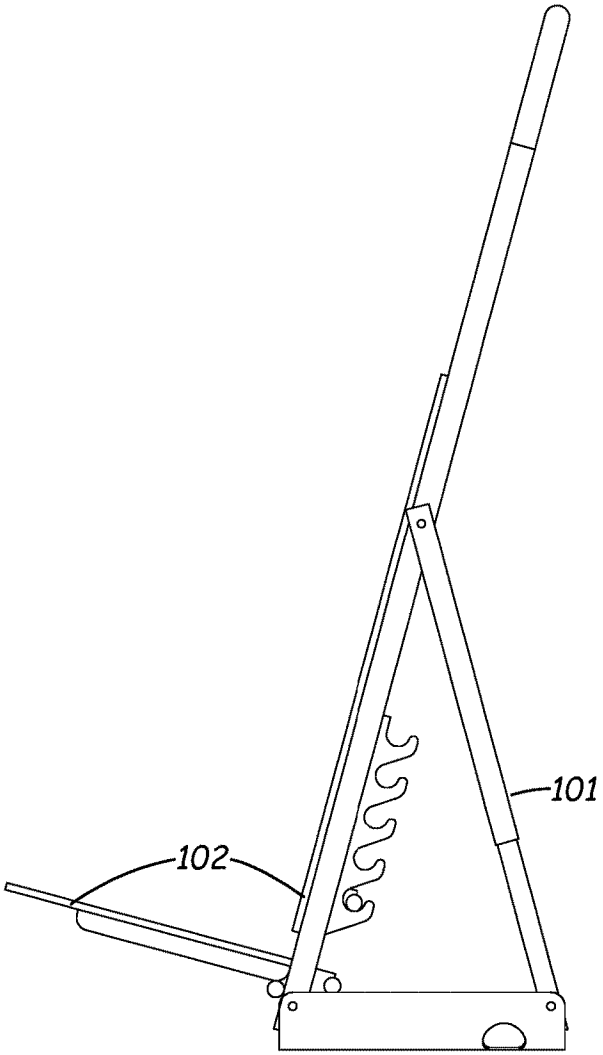
FIG. 5 is a port side view of an embodiment of the disclosure.
Figure 7:
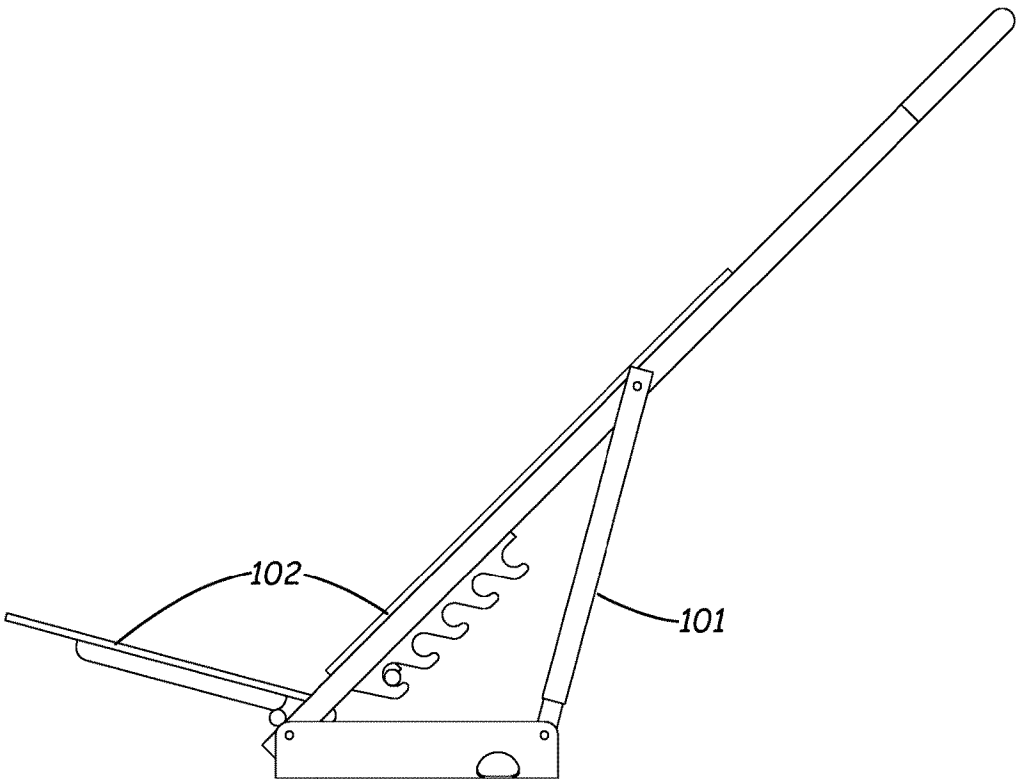
FIG. 7 is a port side view of an embodiment of the disclosure.
Figure 8:
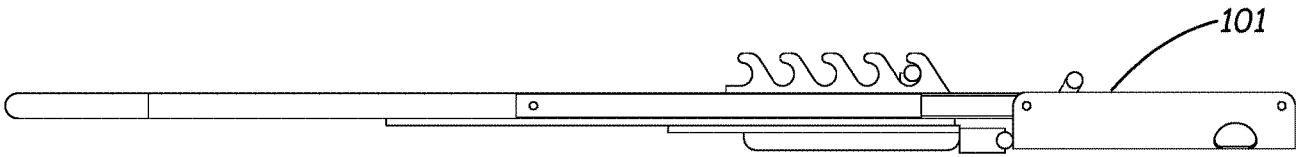
FIG. 8 is a port side view of an embodiment of the disclosure.

Detailed reference will now be made to one or more potential embodiments of the disclosure, which are illustrated in FIGS. 1 through 8.

The adjustable chair and leaning post for a kayak or other watercraft 100 (hereinafter invention) is a mechanical structure. The invention 100 is configured for use with a vessel 103. The invention 100 attaches to the superior surface of the vessel 103. The invention 100 is adapted for use with a client. The client uses the invention 100 for a purpose selected from the group consisting of: a) sitting; and, b) leaning. The invention 100 comprises a framework 101 and a seat structure 102. The framework 101 transfers the load of the client and seat structure 102 to the vessel 103. The seating structure forms a structure that the client sits on. The seating structure further forms a structure that the client leans against. The invention 100 is a collapsible structure. The client is defined elsewhere in this disclosure.

The vessel 103 is further defined with a primary sense of direction 131. The primary sense of direction 131 orients the starboard and port directions used in this disclosure. The primary sense of direction 131, the starboard direction, and the port direction are defined elsewhere in this disclosure.

The framework 101 is a mechanical structure. The framework 101 is a load bearing structure. The framework 101 is a rotating structure. The framework 101 is a collapsible structure. The framework 101 attaches the invention 100 to the vessel 103. The position of the framework 101 on the vessel 103 is selected such that the seat structure 102 is accessible to the client. The framework 101 comprises a supporting structure 111, a pedestal 112, and a plurality of hinges 113.

The supporting structure 111 is a mechanical structure. The supporting structure 111 is a vertically oriented structure. The supporting structure 111 is a u-shaped structure. The seat structure 102 attaches to the supporting structure 111. The supporting structure 111 is a load bearing structure. The supporting structure 111 transfers the load borne by the seat structure 102 to the plurality of hinges 113. The supporting structure 111 elevates the seat structure 102 above the vessel 103. The supporting structure 111 is a telescopic structure. By telescopic structure is meant that the span of the length of the supporting structure 111 is meant that the span of the length of the supporting structure 111 is adjustable. The supporting structure 111 rotates relative to the vessel 103. The rotation of the supporting structure 111 allows for the adjustment of the cant formed between each of the load bearing vectors formed by the supporting structure 111 and the force of gravity.

The supporting structure 111 comprises a starboard supporting shaft 141, a port supporting shaft 142, and a crossbeam 143. The starboard supporting shaft 141 forms a first arm of the u-shaped structure of the supporting structure 111. The port supporting shaft 142 forms a first arm of the u-shaped structure of the supporting structure 111. The crossbeam 143 forms crossbeam 143 of the u-shaped structure of the supporting structure 111.

The starboard supporting shaft 141 is a load bearing structure. The seat structure 102 attaches to the starboard supporting shaft 141. The starboard supporting shaft 141 transfers a portion of the load borne by the seat structure 102 to the pedestal 112. The starboard supporting shaft 141 is a telescopic structure. By telescopic structure is meant that the span of the length of the center axis of the starboard supporting shaft 141 is adjustable. The telescopic structure is defined elsewhere in this disclosure. The starboard supporting shaft 141 further comprises a plurality of starboard detents 151 and a starboard gusset 152.

The plurality of starboard detents 151 forms a plurality of hooks that are attached to the exterior surface of the lateral face of the prism structure of the starboard supporting shaft 141. Each of the plurality of starboard detents 151 forms an anchor point for the bench structure 122. The starboard gusset 152 is a gusset. The starboard gusset 152 attaches the lateral face of the prism structure of the starboard supporting shaft to the pedestal 112. The starboard gusset 152 transfers a portion of the load borne by the starboard supporting shaft 141 to the pedestal 112.

The port supporting shaft 142 is a prism-shaped structure. The port supporting shaft 142 is identical to the starboard supporting shaft 141. The port supporting shaft 142 is a load bearing structure. The seat structure 102 attaches to the port supporting shaft 142. The port supporting shaft 142 transfers a portion of the load borne by the seat structure 102 to the pedestal 112. The port supporting shaft 142 is a telescopic structure. By telescopic structure is meant that the span of the length of the center axis of the port supporting shaft 142 is adjustable. The telescopic structure is defined elsewhere in this disclosure. The port supporting shaft 142 further comprises a plurality of port detents 153 and a port gusset 154.

The plurality of port detents 153 forms a plurality of hooks that are attached to the exterior surface of the lateral face of the prism structure of the port supporting shaft 142. Each of the plurality of port detents 153 forms an anchor point for the bench structure 122. The port gusset 154 attaches the port supporting shaft 142 to the pedestal 112. The port gusset 154 transfers a portion of the load borne by the port supporting shaft 142 to the pedestal 112.

The crossbeam 143 is a prism shaped structure. The crossbeam 143 is a load transfer structure. The crossbeam 143 is a brace that stabilizes the supporting structure 101. The crossbeam 143 attaches the starboard supporting shaft 141 to the port supporting shaft 142. The crossbeam 143 attaches to the superior congruent end of the prism structure of the starboard supporting shaft 141. The crossbeam 143 attaches to the superior congruent end of the prism structure of the port supporting shaft 142.

The pedestal 112 is a mechanical structure. The pedestal 112 attaches the supporting structure 111 to the vessel 103. The pedestal 112 attaches to the vessel 103 in a fixed position. The supporting structure 111 attaches to the pedestal 112 such that the supporting structure 111 rotates relative to the pedestal 112. The position of the attachment of the supporting structure 111 to the pedestal 112 is adjustable. The pedestal 112 comprises a starboard c-channel 161 and a port c-channel 162.

The starboard c-channel 161 is a c-channel. The c-channel is defined elsewhere in this disclosure. The starboard c-channel 161 attaches to a fixed position on the vessel 103. The starboard supporting shaft 141 attaches to the starboard c-channel 161 such that the load borne by the starboard supporting shaft 141 transfers to the vessel 103 through the starboard c-channel 161. The starboard supporting shaft 141 attaches to the starboard c-channel 161 such that the starboard supporting shaft rotates relative to the starboard c-channel 161. The starboard gusset 152 attaches to the starboard c-channel 161 such that the load borne by the starboard gusset 152 transfers to the vessel 103 through the starboard c-channel 161. The starboard gusset 152 attaches to the starboard c-channel 161 such that the starboard gusset 152 rotates relative to the starboard c-channel 161. The starboard gusset 152 may be telescopic in nature such that the angle or cant of the supporting structure 111 is adjustable.

The port c-channel 162 is a c-channel. The c-channel is defined elsewhere in this disclosure. The port c-channel 162 attaches to a fixed position on the vessel 103. The port supporting shaft 142 attaches to the port c-channel 162 such that the load borne by the port supporting shaft 142 transfers to the vessel 103 through the port c-channel 162. The port supporting shaft 142 attaches to the port c-channel 162 such that the port supporting shaft 142 rotates relative to the port c-channel 162. The port gusset 154 is a telescopic structure that attaches to the port c-channel 162 such that the load borne by the port gusset 154 transfers to the vessel 103 through the port c-channel 162. The port gusset 154 may be lockable in order to lock the angle or cant of the supporting structure 111 to be locked. The port gusset 154 attaches to the port c-channel 162 such that the port gusset 154 rotates relative to the port c-channel 162.

Each of the plurality of hinges 113 may be a locking hinge. Each of the plurality of hinges 113 forms an attachment selected from the group consisting of: a) attaching the supporting structure 111 to the pedestal 112; and, b) a first structural element of the supporting structure 111 to a second structural element of the supporting structure 111. The plurality of hinges 113 allows the supporting structure 111 to rotate between a collapsed position and a deployed position.

The plurality of hinges 113 comprises a first hinge 171, a second hinge 172, a third hinge 173, a fourth hinge 174, a fifth hinge 175, and a sixth hinge 176.

The first hinge 171 attaches the congruent end of the starboard supporting shaft 141 that is distal from the crossbeam 143 to the starboard c-channel 161 such that the starboard supporting shaft 141 rotates relative to the starboard c-channel 161. The first hinge 171 supports the starboard supporting shaft 141 into a fixed position relative to the starboard c-channel 161.

The second hinge 172 attaches the congruent end of the starboard gusset 152 that is distal from the starboard c-channel 161 to the lateral face of the starboard supporting shaft 141 such that the starboard gusset 152 rotates relative to the starboard supporting shaft 141. The starboard gusset 152 is telescopic. The second hinge 172 supports the starboard gusset 152 into a fixed position relative to the lateral face of the starboard supporting shaft 141.

The third hinge 173 attaches the congruent end of the starboard gusset 152 that is distal from the starboard supporting shaft 141 to the starboard c-channel 161 such that the starboard gusset 152 rotates relative to the starboard c-channel 161. The third hinge 173 supports the starboard gusset into a fixed position relative to the starboard c-channel 161. The third hinge 173 attaches the starboard gusset 152 to the starboard c-channel 161 such that the horizontal position of the starboard gusset 152 relative to the starboard c-channel 161 is adjustable.

The fourth hinge 174 attaches the congruent end of the port supporting shaft 142 that is distal from the crossbeam 143 to the port c-channel 162 such that the port supporting shaft 142 rotates relative to the port c-channel 162. The fourth hinge supports the port supporting shaft 142 into a fixed position relative to the port c-channel 162.

The fifth hinge 175 attaches the congruent end of the port gusset 154 that is distal from the port c-channel 162 to the lateral face of the port supporting shaft 142 such that the port gusset 154 rotates relative to the port supporting shaft 142. The fifth hinge 175 supports the port gusset 154 into a fixed position relative to the lateral face of the port supporting shaft 142.

The sixth hinge 176 attaches the congruent end of the port gusset 154 that is distal from the port supporting shaft 142 to the port c-channel 162 such that the port gusset 154 rotates relative to the port c-channel 162. The sixth hinge 176 supports the port gusset 154 into a fixed position relative to the port c-channel 162. The sixth hinge 176 attaches the port gusset 154 to the port c-channel 162 such that the horizontal position of the port gusset 154 relative to the port c-channel 162 is adjustable.

The seat structure 102 forms a structure on which the client sits. The seat structure 102 further forms a structure against which the client leans. The seat structure 102 removably attaches to the framework 101. The seat structure 102 can rotate up into a parallel position relative to the framework 101 before the framework 101 is collapsed to form a reduced volume structure. The seat structure 102 comprises a backrest structure 121 and a bench structure 122.

The backrest structure 121 is a mechanical structure. The backrest structure 121 removably attaches to the supporting structure 111. The elevation of the backrest structure 121 adjusts by adjusting the attachment position on the supporting structure 111. The backrest structure 121 forms a vertically canted structure the client leans against. The backrest structure 121 further comprises a backrest plate 181 and a backrest detent 182.

The backrest plate 181 is a disk-shaped cushioned structure. The backrest plate 181 forms a vertically oriented structure. The client leans against the backrest plate 181.

The backrest detent 182 is a mechanical structure that physically attaches the backrest plate 181 to both the starboard supporting shaft 141 and the port supporting shaft 142 such that the elevation of the backrest plate 181 is adjustable.

The bench structure 122 is a mechanical structure. The bench structure 122 removably attaches to the supporting structure 111. The elevation of the bench structure 122 adjusts by adjusting the attachment position on the supporting structure 111. The bench structure 122 forms a horizontally oriented structure the client sits on. The bench structure 122 further comprises a bench plate 183 and a bench detent 184.

The bench plate 183 is a disk-shaped cushioned structure. The bench plate 183 forms a horizontally oriented structure. The client sits on the bench plate 183. The bench detent 184 is a mechanical structure that physically attaches the bench plate 183 to the supporting structure 111. The bench detent 184 is a mechanical structure that physically attaches the bench plate 183 to a starboard detent selected from the plurality of starboard detents 151 of the starboard supporting shaft 141. The bench detent 184 is a mechanical structure that physically attaches the bench plate 183 to a port detent selected from the plurality of port detents 153 of the port supporting shaft 142. The elevation of the bench detent 184 is adjustable.

The following definitions were used in this disclosure:

Aft: As used in this disclosure, aft is a term that relates a first object to a second object. When the second object is closer to the stern of a vehicle, the second object is said to be aft of the first object. The term is commonly used on vessels and vehicles.

23 Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Anterior: As used in this disclosure, anterior is a term that is used to refer to the front side or direction of a structure. When comparing two objects, the anterior object is the object that is closer to the front of the structure.

Backrest: As used in this disclosure, a backrest is a vertical or vertically canted supporting surface formed along the posterior side of a chair. The backrest supports the back of a person sitting in the chair.

Bow: As used in this disclosure, the bow refers to the anterior side of an object, vehicle, or vessel. Specifically, the bow refers to the most forward element of the object in the direction of the primary sense of direction of the object vehicle, or vessel.

Brace: As used in this disclosure, a brace is a rigid structural element that interconnects a first object with a second object to form a resulting object. The brace forms an energy transfer structure that distributes and shares the forces applied to the resulting object between the first object and the second object. The brace is used to support, stabilize, or otherwise steady an object.

C-Channel: As used in this disclosure, the C-channel is a load bearing structure, such as a beam, that is formed in a U-shape. The C-channel forms a prism shape with a hollow interior and an open lateral face that forms a shape characteristic of the letter C when viewed from the congruent ends. The open space of the C-channel is often used as a track. A C-channel is a U-shaped structure.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Chair: As used in this disclosure, a chair is a structure that a person can sit on. The horizontal resting surface a person sits on is called the bench. Seat is a common synonym for a chair.

Collapsible: As used in this disclosure, the terms collapsible refers to an object that is configured such that the volume of the object is adjustable. By volume is meant the volume of the perimetrical boundary that contains the object. The verbs collapse and retract mean that the volume of the perimetrical boundary of the object changes from a larger volume to a smaller volume. The verbs expand and deploy mean that the volume of the perimetrical boundary of the object changes from a smaller volume to a larger volume. Always use perimetrical boundary Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Detent: As used in this disclosure, a detent is a device for attaching a first object to a second object in a detachable manner.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Forward: As used in this disclosure, forward is a term that relates a first object to a second object. When the first object is closer to the bow of a vehicle, the first object is said to be forward of the second object. The term is commonly used on vessels and vehicles.

Framework: As used in this disclosure, a framework refers to the substructure of an object that forms the load path for the object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Gusset: As used in this disclosure, a gusset is an angled structural member used to stabilize a section of a framework.

By angled is meant that the gusset is neither parallel nor perpendicular to the structures being stabilized.

Hinge: As used in this disclosure, a hinge is a device that permits the turning, rotating, or pivoting of a first object relative to a second object. A hinge designed to be fixed into a set position after rotation is called a locking hinge. A spring loaded hinge is a hinge formed as an elastic structure. The elastic structure of the spring loaded hinge is deformed under a rotating force such that the elastic structure returns the spring loaded hinge back to its relaxed shape after the rotating force is removed from the spring loaded hinge.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Lateral: As used in this disclosure, the term lateral refers to the movement of an object that is perpendicular to the primary sense of direction of an object and parallel to the horizontal plane (or perpendicular to the vertical plane). Lateral movement is always perpendicular to the anterior posterior axis. Lateral movement is often called sideways movement.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Lock: As used in this disclosure, a lock is a releasable fastening device that secures a rotating mechanical device into a fixed position.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Openwork: As used in this disclosure, the term open work is used to describe a structure, often a surface, which is formed with one or more openings that allow for visibility and fluid flow through the structure. Wrought work and meshes are forms of openwork.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Pedestal: As used in this disclosure, a pedestal is an intermediary load bearing structure that forms a load path between a supporting surface and an object, structure, or load.

Perimeter: As used in this disclosure, a perimeter is one or more curved or straight lines that bounds an enclosed area on a plane or surface. The perimeter of a circle is commonly referred to as a circumference.

Perimetrical Boundary: As used in this disclosure, a perimetrical boundary is a hypothetical rectangular block that contains an object. Specifically, the rectangular block selected to be the perimetrical boundary is the rectangular block with the minimum volume that fully contains the object. In a two-dimensional structure, the perimetrical boundary is the rectangle with the minimum surface area.

Pivot: As used in this disclosure, a pivot is a rod or shaft around which an object rotates or swings.

Port: As used in this disclosure, port refers to the left side of a vehicle when a viewer is facing towards the primary sense of direction of the vehicle.

Posterior: As used in this disclosure, posterior is a term that is used to refer to the side of an object that is distal or in the opposite direction of the anterior side. When comparing two items, the posterior item is the item that is distal from the anterior of the object.

Primary Sense of Direction: As used in this disclosure, the primary sense of direction of an object refers to a vector that: 1) passes through the center of the object; and, 2) is parallel to the direction of travel when the anterior surface(s) of the object are leading the object into the direction of travel. This definition intends to align with what people would normally call the forward direction of an object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Starboard: As used in this disclosure, starboard refers to the right side of a vehicle when a viewer is facing towards the primary sense of direction of the vehicle.

Stern: As used in this disclosure, the stern refers to the posterior side of an object, vehicle, or vessel. The stern is distal from the bow along the primary sense of direction.

Such As: As used in this disclosure, the term "such as" is a conjunction that relates a first phrase to a subsequent phrase. The term "such as" is used to introduce representative examples of structures that meet the requirements of the first phrase. As a first example of the use of the term "such as," the phrase: "the first textile attaches to the second textile 6 using a fastener such as a hook and loop fastener" is taken to mean that a hook and loop fastener is suitable to use as the fastener but is not meant to exclude the use of a zipper or a sewn seam. As a second example of the use of the term "such as," the phrase: "the chemical substance is a halogen such as chlorine or bromine" is taken to mean that either chlorine or bromine are suitable for use as the halogen but is not meant to exclude the use of fluorine or iodine.

Such That: As used in this disclosure, the term "such that" is a conjunction that relates a first phrase to a subsequent phrase. The term "such that" is used to place a further limitation or requirement to the first phrase. As a first example of the use of the term "such that," the phrase: "the door attaches to the wall such that the door rotates relative to the wall" requires that the attachment of the door allows for this rotation. As a second example of the use of the term "such that," the phrase: "the chemical substance is selected such that the chemical substance is soluble in water" requires that the selected chemical substance is soluble in water. As a third example of the use of the term "such that," the phrase: "the lamp circuit is constructed such that the lamp circuit illuminates when the lamp circuit detects darkness" requires that the lamp circuit: a) detect the darkness; and, b) generate the illumination when the darkness is detected.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Telescopic: As used in this disclosure, telescopic is an adjective that describes a composite prism structure made of hollow prism-shaped sections that fit or slide into each other such that the composite prism structure can be made longer or shorter by adjusting the relative positions of the hollow prism-shaped sections.

Triangle: As used in this disclosure, a triangle is an enclosed geometric shape with a perimeter that is formed by three intersecting edges that form three vertices. The triangle is considered a polygon. The longest edge of the triangle is called the hypotenuse. The remaining two edges are called the legs of the triangle. If the measure of the interior angle with the largest arc formed by the triangle is greater than 90 degrees, then the triangle is called an obtuse triangle. If the measure of the interior angle with the largest arc formed by the triangle equals 90 degrees, then the triangle is called a right triangle. If the measure of the interior angle with the largest arc formed by the triangle is lesser than 90 degrees, then the triangle is called an acute triangle. An equilateral triangle has three edges of equal length. An isosceles triangle has two edges (the legs) of equal length. A scalene triangle has edges of three different lengths.

U-Shaped Structure: As used in this disclosure, a U-shaped structure is a type of offset composite prism structure. The U-shaped structure is a three sided structure comprising a crossbeam, a first arm, and a second arm. In a U-shaped structure, the first arm and the second arm project away from the crossbeam: 1) in the same direction; 2) at a roughly perpendicular angle to the crossbeam, and, 3) the span of length of the first arm roughly equals the span of length of the second arm. An illiterate U-shaped structure refers to a U-shaped structure wherein the span of the length of the first arm differs from the span of the length of the second arm by more than 10 percent. A guided U-shaped structure refers to a U-shaped structure that has: a) the first arc formed by the interior cant formed between the first arm and the crossbeam is greater than or equal to 100 degrees; b) a second arc formed by the interior cant formed between the second arm and the crossbeam is greater than or equal to 100 degrees; and, c) the first arc and the second arc are roughly equal.

Vehicle: As used in this disclosure, a vehicle is a device that is used for transporting passengers, goods, or equipment. The term motorized vehicle specifically refers to a vehicle can move under power provided by an electric motor or an internal combustion engine. The term vehicle generically applies to motorized vehicles and vehicles without a motor.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Vessel: As used in this disclosure, a vessel is a type of vehicle. A vessel transports passengers, goods, or equipment over water.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An adjustable chair and leaning post comprising:

a mechanical, load bearing, rotating, and collapsible framework that attaches the adjustable chair and the leaning post to a vessel, where the framework is configured to transfer a load of a client and seat structure to the vessel and is configured to attach to a superior surface of the vessel; where the framework comprises:

a mechanical, vertically-oriented, U-shaped, load bearing, and telescopic supporting structure with an adjustable length, where the support structure rotates relative to the vessel, allowing for the adjustment of a cant formed between each of a plurality of load bearing vectors formed by the supporting structure and gravity the supporting structure comprising:

a telescopic and load bearing starboard supporting shaft that forms a first arm of the U-shape of the supporting structure, wherein a length of a center axis of the starboard supporting shaft is adjustable;

a telescopic load bearing port supporting shaft that forms a second arm of the U-shape of the supporting structure, wherein the port supporting shaft is identical to the starboard supporting shaft, and where a length of a center axis of the port supporting shaft is adjustable; and a crossbeam that forms a crossbeam of the U-shape of the supporting structure, where the crossbeam:

is a load transfer structure and a brace that stabilizes the supporting structure;

attaches the starboard supporting shaft to the port supporting shaft;

attaches to a superior congruent end of the starboard supporting shaft;

attaches to a superior congruent end of the port supporting shaft;

a mechanical pedestal that attaches the supporting structure to the vessel in a fixed position, where the supporting structure rotates relative to the pedestal; and where the position of the attachment of the supporting structure to the pedestal is adjustable, where the pedestal comprises a starboard c-channel and a port c-channel that each attach to a fixed position on the vessel; and a plurality of hinges that attach the supporting structure to the pedestal and that attach a first structural element of the supporting structure to a second structural element of the supporting structure, where the plurality of hinges allow the supporting structure to rotate between a collapsed position and a deployed position, and where a lockable structure of the plurality of hinges allows the supporting structure to be fixed in the deployed position; and a seat that forms both a seating structure that removably attaches to the framework and a leaning structure, where the seat comprises:

a mechanical backrest that forms a vertically canted structure, where the mechanical backrest is removably configured to attach to the supporting structure, and where an elevation of the backrest adjusts by adjusting an attachment position on the supporting structure;

and a mechanical bench that removably attaches to the supporting structure, where an elevation of the bench is adjusted by adjusting the attachment position on the supporting structure;

wherein the adjustable chair and leaning post is a collapsible structure;

where the seat is removed from the framework before the framework is collapsed to form a structure of reduced volume;

where the supporting structure transfers a load borne by the seat to the plurality of hinges and elevates the seat above the vessel;

where the seat attaches to the starboard supporting shaft and the port supporting shaft, and where the starboard supporting shaft and the port supporting shaft both transfer a portion of the load borne by the seat to the pedestal;

where the starboard supporting shaft attaches to the starboard c-channel such that a load borne by the starboard supporting shaft transfers to the vessel through the starboard c-channel and such that the starboard supporting shaft rotates relative to the starboard c-channel; and where the port supporting shaft attaches to the port c-channel such that a load borne by the port supporting shaft transfers to the vessel through the port c-channel and such that the port supporting shaft rotates relative to the port c-channel.

2. The adjustable chair and leaning post of claim 1, where the vessel is a kayak.

3. The adjustable chair and leaning post of claim 1, where the starboard supporting shaft comprises a plurality of starboard detents and a starboard gusset.

4. The adjustable chair and leaning post of claim 3, where the plurality of starboard detents form a plurality of hooks attached to an exterior surface of a lateral face of a prism structure of the starboard supporting shaft.

5. The adjustable chair and leaning post of claim 3, where the starboard gusset attaches a lateral face of a prism structure of the starboard supporting shaft to the pedestal.

6. The adjustable chair and leaning post of claim 3, where the starboard gusset transfers a portion of the load borne by the starboard supporting shaft to the pedestal.

7. The adjustable chair and leaning post of claim 1, where the port supporting shaft comprises a plurality of port detents and a port gusset.

8. The adjustable chair and leaning post of claim 7, where the plurality of port detents form a plurality of hooks attached to an exterior surface of a lateral face of a prism structure of the port supporting shaft.

9. The adjustable chair and leaning post of claim 7, where the port gusset attaches the port supporting shaft to the pedestal.

10. The adjustable chair and leaning post of claim 7, where the port gusset transfers a portion of the load borne by the port supporting shaft to the pedestal.

11. The adjustable chair and leaning post of claim 1, where each of the plurality of hinges is a locking hinge.

12. The adjustable chair and leaning post of claim 1, where an elevation of the backrest is adjustable by adjusting the attachment position on the supporting structure.

13. The adjustable chair and leaning post of claim 12, where the backrest comprises a backrest plate and a backrest detent.

14. The adjustable chair and leaning post of claim 13, where the backrest plate forms a vertically oriented structure.

15. The adjustable chair and leaning post of claim 13, where the backrest detent attaches the backrest plate to both the starboard supporting shaft and the port supporting shaft such that the elevation of the backrest plate is adjustable.

16. The adjustable chair and leaning post of claim 1, where the bench comprises a bench plate and a bench detent.

17. The adjustable chair and leaning post of claim 16, where the bench plate forms a horizontally oriented structure.

18. The adjustable chair and leaning post of claim 16, where the bench detent attaches the bench plate to the supporting structure.

19. The adjustable chair and leaning post of claim 16, where the bench detent attaches the bench plate to one of a plurality of starboard detents of the starboard supporting shaft.

20. The adjustable chair and leaning post of claim 16, where the bench detent attaches the bench plate to one of a plurality of port detents of the starboard supporting shaft.

* * * * *